US009326651B2

(12) United States Patent
Alshehri

(10) Patent No.: US 9,326,651 B2
(45) Date of Patent: May 3, 2016

(54) VACUUM CLEANER WITH BLOWER AND FLEXIBLE HEAD FOR IMPROVED PARTICULATE REMOVAL

(76) Inventor: Mohammed Jarallah Alshehri, Indianapolis, IN (US)

( * ) Notice: Subject to any disclaimer, the term of this patent is extended or adjusted under 35 U.S.C. 154(b) by 1044 days.

(21) Appl. No.: 13/455,788

(22) Filed: Apr. 25, 2012

(65) Prior Publication Data

US 2013/0283562 A1 Oct. 31, 2013

(51) Int. Cl.
*A47L 9/08* (2006.01)
*A47L 5/14* (2006.01)

(52) U.S. Cl.
CPC .... *A47L 5/14* (2013.01); *A47L 9/08* (2013.01)

(58) Field of Classification Search
CPC ..... A47L 5/14; A47L 9/08
USPC ..... 15/405, 416, 415.1
IPC ..... A47L 9/08
See application file for complete search history.

(56) References Cited

U.S. PATENT DOCUMENTS 3,085,267 A * 4/1963 Jacuzzi ..... A47L 9/02 15/1.7
3,605,171 A * 9/1971 Candor et al. ..... A47L 9/02 15/322
3,780,398 A * 12/1973 Candor ..... A47L 9/02 15/415.1
4,884,315 A 12/1989 Ehnert
5,189,757 A 3/1993 Williams et al.
5,450,649 A 9/1995 Turnbull
5,457,848 A 10/1995 Miwa
5,718,016 A * 2/1998 Sung ..... A47L 5/24 15/227
6,052,861 A 4/2000 Keller
6,080,243 A * 6/2000 Insley ..... B05C 17/002 134/21
6,195,834 B1 3/2001 Shteingold
6,517,640 B2 2/2003 Deng
6,957,472 B2 10/2005 Illingworth et al.
7,520,298 B2 4/2009 George et al.
7,788,765 B2 9/2010 Allen
2003/0132152 A1 * 7/2003 Illingworth ..... A47L 9/08 210/167.1
2004/0255427 A1 * 12/2004 Gavney, Jr. ..... A46B 9/005 15/401
2007/0039123 A1 2/2007 Bird
2009/0044372 A1 2/2009 Knopow et al.

* cited by examiner

*Primary Examiner* — David Redding
(74) *Attorney, Agent, or Firm* — Oblon, McClelland, Maier & Neustadt, L.L.P

(57) ABSTRACT

A vacuum cleaner with a flexible head portion and combined suction and blowing mechanism to agitate debris. An external pressured air source is used to provide a source of pressured air for the blowing mechanism. The head portion has blowing and suction nozzles arranged such that the suction nozzles surround the blowing nozzles or vice versa. The blowing and suction nozzles may be in parallel rows and may have almost perpendicular trajectories. The blowing mechanism may be operated according to an alternating pulsing pattern corresponding to different blowing nozzle groups to create a repeating and bidirectional agitation effect onto stubborn debris in the area between the nozzle groups. The flexible head portion is formed by a grid of head portion units attached to each other by a joining mechanism. The flexible head portion has a concave shape in its relaxed state and can at least partially conform to irregular surfaces.

8 Claims, 7 Drawing Sheets

VACUUM CLEANER WITH BLOWER AND FLEXIBLE HEAD FOR IMPROVED PARTICULATE REMOVAL

GRANT OF NON-EXCLUSIVE RIGHT

This application was prepared with financial support from the Saudi Arabian Cultural Mission, and in consideration therefore the present inventor(s) has granted The Kingdom of Saudi Arabia a non-exclusive right to practice the present invention.

BACKGROUND

1. Field of the Disclosure

This invention relates to vacuum cleaners. More specifically, this invention relates to vacuum cleaners for improved particulate removal using a combination of a blowing and a suction mechanism. This invention further relates to vacuum cleaners with flexible heads to conform to irregular surfaces to be cleaned.

2. Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

A conventional vacuum cleaner includes a head portion that is in contact with the surface to be cleaned, a tube or a flexible hose or a combination thereof to connect the head portion to a main body, and an air suction mechanism housed in the main body. Once the suction mechanism is turned on, the tube provides a suction flow path to the head portion, so dirt, dust, and other debris could be removed from the surface to be cleaned. The main body typically includes a dirt bag or container to collect the debris.

The suction mechanism in the main body is conventionally generated by an electric motor driving a fan. A suction flow path connects the low pressure side of the fan to the head portion. Conventionally, an exhaust flow path connects the high pressure side of the fan to a filtered exhaust to establish an exhaust air flow from the high pressure side of the fan to outside the main body.

The head portion of a vacuum cleaner is conventionally equipped with a mechanical agitator, mimicking a sweeping function. The agitator may be in the form of a stationary brush or a rotating brush which rolls as the head portion is moved against the cleaning surface. Alternatively, the brush may be mechanically driven by an electric motor which is primarily used for the mechanical agitator. Alternatively, the brush may be mechanically driven by a belt to connect to the electric motor within the main body which is primarily used for the suction mechanism.

The mechanical agitator is sometimes undesirable due to the nature of the surface to be cleaned. Delicate material or surfaces prohibit the use of a mechanical brush as it might cause damage to the surface. One remedy is to substitute the mechanical agitator with a touchless agitation mechanism where the debris is agitated by a pressured air flow blown to the surface to be cleaned. This option also provides for better dusting when the surface to be cleaned has hard to reach dusty grooves, an example of which is a keyboard. The touchless agitation mechanism may also be used in conjunction with the conventional mechanical agitator for improved debris removal.

To provide the pressured air flow for the touchless agitation mechanism, the exhaust air flow of the suction mechanism may be recycled, and connected to the head portion by a suction flow path. The cleaning head may be equipped with additional nozzles dedicated to the pressured air flow.

Alternatively, the touchless agitation mechanism may be provided by another motor driving a fan, wherein a blowing flow path connects the high pressure side of the fan to the head portion.

Several embodiments of such agitation mechanisms have been suggested in the prior art, as in e.g., Bird (U.S. App. No. 2007/0039123), Deng (U.S. Pat. No. 6,517,640), Knopow et al. (U.S. App. No. 2009/0044372), and Miwa (U.S. Pat. No. 5,457,848); each of which is incorporated here by reference in its entirety such that the structural components and architectural features such as assembly structures, attachment mechanisms, and electrical designs described therein are a part of the present disclosure.

SUMMARY

This disclosure relates to a vacuum cleaner with an improved blower to agitate debris to be removed. Additionally, this disclosure relates to an improved vacuum cleaner with a flexible head portion to conform to irregular surfaces.

According to a preferred embodiment, a vacuum cleaner is described with a combined suction and blowing mechanism. The blowing mechanism is used to agitate debris, while the suction mechanism is used to collect the agitated debris. The blowing and suction mechanisms affect the same surface area to be cleaned. The blowing and suction mechanisms may be activated simultaneously or may be activated according to different timing patterns. The head portion may be equipped with a plurality of blowing and suction nozzles arranged according to a plurality of patterns.

According to a preferred embodiment, the blowing and suction nozzles may be arranged such that the suction nozzles surround the blowing nozzles.

According to another embodiment, the blowing and suction nozzles may be arranged such that the blowing nozzles surround the suction nozzles.

According to another embodiment, the blowing and suction nozzles may be arranged in almost parallel rows.

According to another embodiment, the suction and blowing nozzles may have almost perpendicular trajectories.

According to a preferred embodiment, the suction and blowing mechanisms may be operated according to an alternating pulsing pattern.

According to another embodiment, the blowing mechanism may be operated according to an alternating pulsing pattern corresponding to different blowing nozzle groups so as to create a repeating and bidirectional agitation effect onto the stubborn debris.

According to a preferred embodiment, the blowing mechanism is caused by a pressured air source. The pressured air source may be an external pressured air container which may be attached to the main body and connected to the head portion via a tube or pipe. Alternatively, the pressured air source may be from the high pressure side of a fan run by a motor housed in the main body and used primarily for the suction mechanism. Alternatively, the pressured air source may be provided by a separate fan run by a separate motor primarily used for the blowing mechanism.

The blowing mechanism may be additionally used for exposing the surface to be cleaned to a treatment material, e.g., disinfectant, antibacterial, deodorizer, pesticide, fungicide. The treatment material may be mixed with the pressured air of the blowing mechanism anywhere along the path of the pressured air flow from the source of the pressured air to the blowing nozzles.

According to a preferred embodiment, the head portion may be made of rigid material so it has a fixed shape.

According to another embodiment, the head portion may be flexible so it could at least partially take the shape of an irregular surface to be cleaned. Such flexibility can be provided by arranging a grid of all rigid head portion units attached to each other by flexible or movable joining mechanisms so the grid of the head portion units can conform to irregular surfaces. This will provide for better contact between the flexible head portion and the irregular surface, resulting in more effective suction from and blowing onto the irregular surface, and consequently, improved particulate removal.

In any of the above described embodiments, the blowing nozzles and the suction nozzles may be configured such that the trajectory of the blowing nozzles at least partially coincides with the trajectory of the suction nozzles, thereby providing for a more efficient combination of suction and blowing. In this aspect of the invention the blowing air forms an air stream that is directed to the suction(s). The air stream is better able to transport and dislodge dirt from a substrate being cleaned.

For example, the blowing air (e.g., pressurized air) can be directed by nozzles proximal to a major suction port on the vacuum head such that the blowing air direction is coincident with the vacuum suction. In another embodiment each suction nozzle is surrounded by a plurality of blowing nozzles or is proximal to at least one blowing nozzle so that the blowing nozzles directs a stream of air or gas in the plane of the vacuum head toward the suction nozzle.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1A:
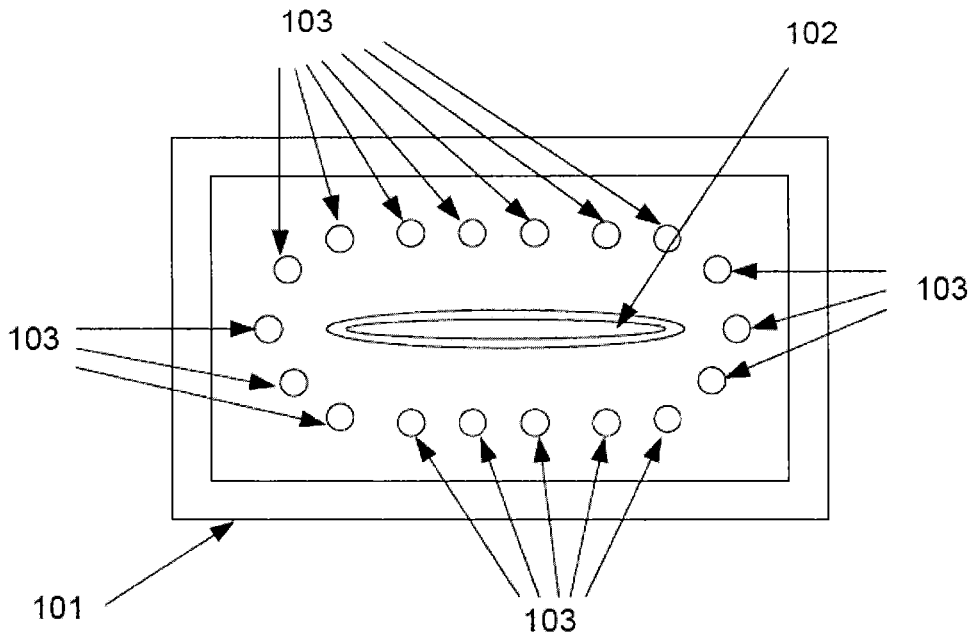
FIGS. 1A and 1B are illustrative views of two embodiments of a head portion of a vacuum cleaner.

Referring now to the drawings, wherein like reference numerals designate identical or corresponding parts throughout the several views.

Figure 1B:
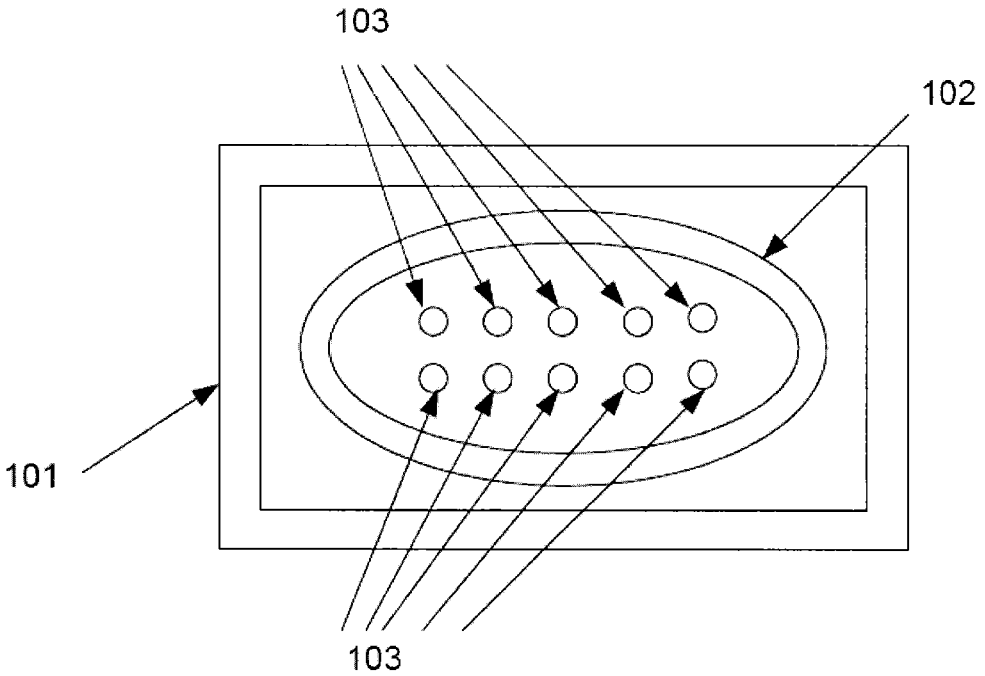

FIGS. 1A and 1B are illustrative views of two embodiments of a head portion 101 of a vacuum cleaner. FIG. 1A shows a bottom view of a head portion 101, where a suction nozzle 102 is surrounded by a plurality of blowing nozzles 103. FIG. 1B shows a bottom view of a head portion 101, where a plurality of blowing nozzles 103 are surrounded by a suction nozzle 102.

Figure 2A:
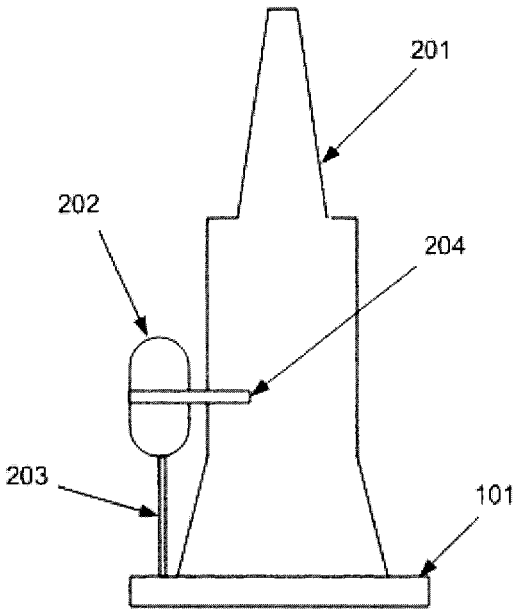
FIGS. 2A and 2B are illustrative views of two embodiments of an external pressured air source attached to the main body of a vacuum cleaner and attached to an external head portion respectively.

FIG. 2A is an illustrative view of an embodiment of an external pressured air source 202 attached to the main body of a vacuum cleaner 201. The external pressured air source 202 is connected to the head portion 101 of the vacuum cleaner 201 by a pipe 203. The external pressured air source 202 is attached to the main body 201 of the vacuum cleaner by a strap 204.

Figure 2B:
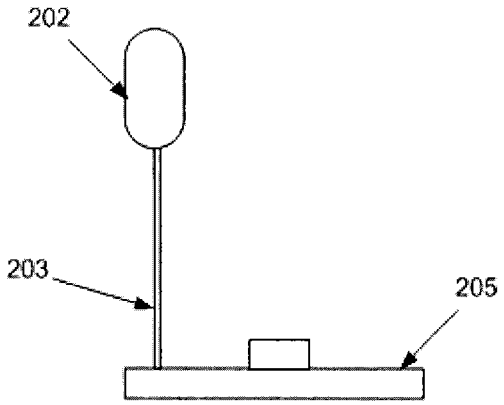

Alternatively and as shown in FIG. 2B, the external pressured air source 202 may be connected to an external head portion 205 having blowing nozzles. The external head portion can then replace the head portion of a conventional vacuum cleaner with no blowing mechanism, or may be used at the same time and affecting the same surface as the head portion of a conventional vacuum cleaner with no blowing mechanism.

In this embodiment of the invention the external pressured air source may conveniently and quickly be attached to and/or adapted to accommodate a conventional vacuum cleaner. Using the external pressurized air source with a conventional vacuum cleaner improves the ability of the conventional vacuum cleaner to remove dirt by using the force of pressurized air to dislodge dirt from a surface and blow the dirt into the suction of the conventional vacuum cleaner.

Figure 3:
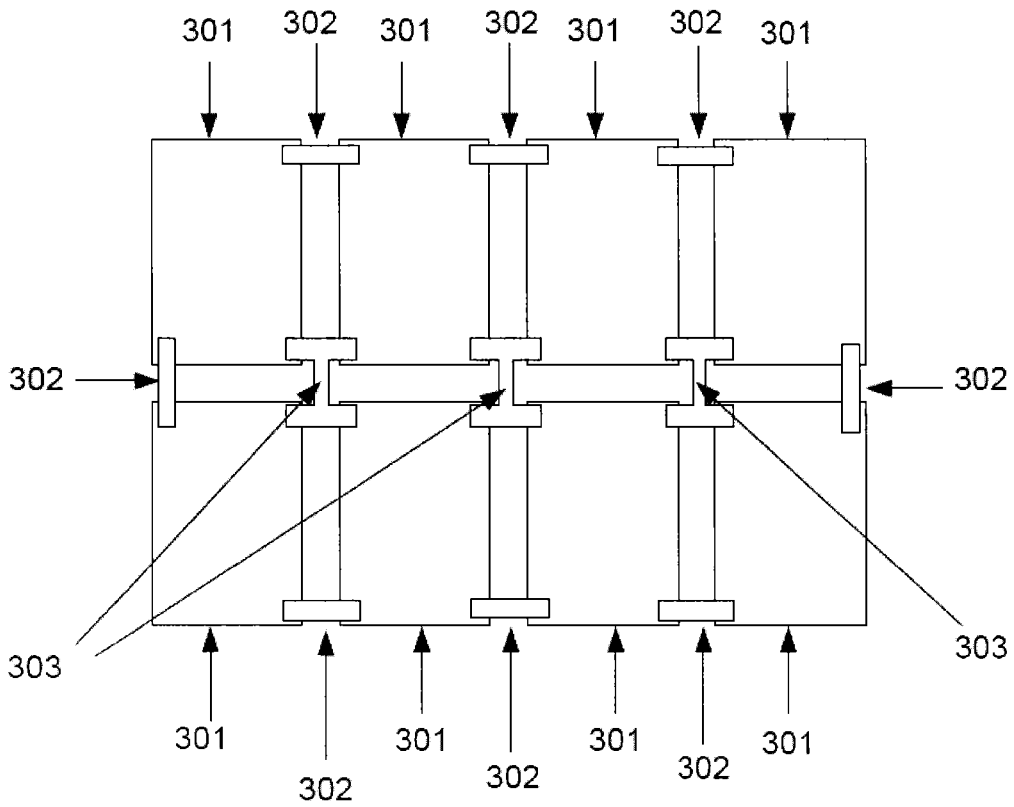
FIG. 3 is an illustrative view of a first embodiment of a flexible head portion.

FIG. 3 is an illustrative view of a first embodiment of a flexible head portion. The flexible head portion is composed of a grid of head portion units 301. The head portion units 301 are attached to each other by flexible two-way joints 302 and flexible four-way joints 303. The flexible two-way joints 302 and four-way joints 303 have a concave shape in their relaxed state, such that the flexible head portion units are at least partially pulled toward each other and form a hollow concave shape. Further details regarding the flexible two-way joints 302 and four-way joints 303 will be provided later.

Figure 4:
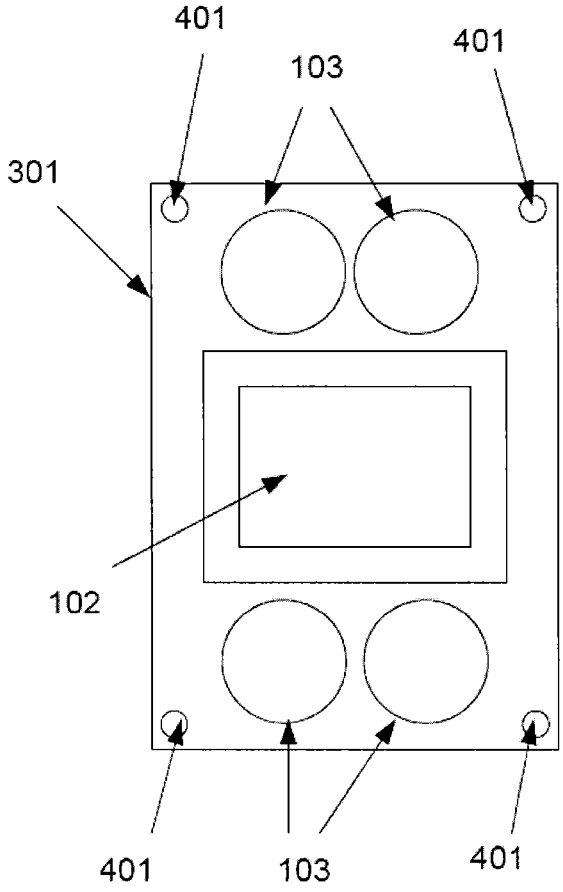
FIG. 4 is an illustrative view of a first embodiment of a head portion unit.

FIG. 4 is an illustrative view of a first embodiment of a head portion unit. The head portion unit 301 has a suction nozzle 102, and a plurality of blowing nozzles 103. The head portion unit 301 has holes 401 in the corners to receive, depending on the relative position of the head portion unit in the grid of the head portion units, a flexible two-way joint 302, a flexible four-way joint 303, or no joint.

Figure 5A:
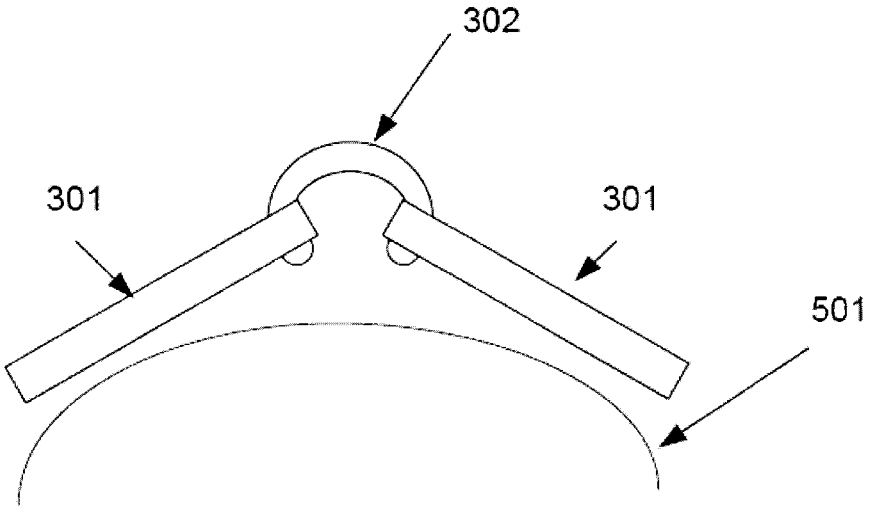
FIGS. 5A and 5B are illustrative views of a first embodiment of a flexible head portion when used against a convex surface, and when used against a flat surface, respectively.
Figure 5B:
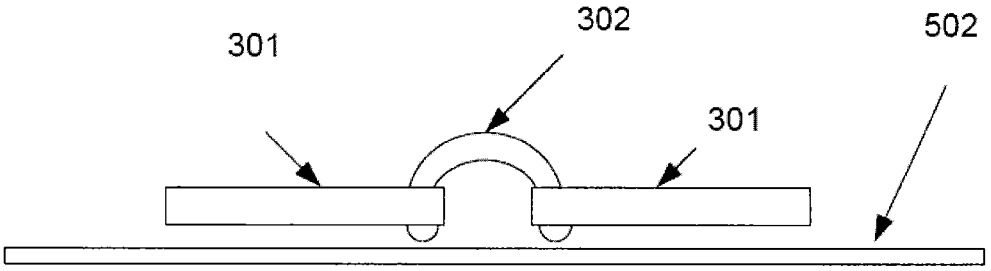

FIGS. 5A and 5B are illustrative views of a first embodiment of a flexible head portion when used against a convex surface 501, and when used against a flat surface 502, respectively. The combination of the head portion units 301, when connected by a two way joint 302 in its relaxed state, takes a concave shape that at least partially surrounds a convex surface 501, thereby causing improved contact with the convex surface 501. When the combination of the head portion units 301 is forced upon a flat surface 502, the head portion units 301 spread out, and the flexible two-way joint 302 is forced into a pressed state. The head portion units 301 then make close contact with the flat surface 502.

Figure 6A:
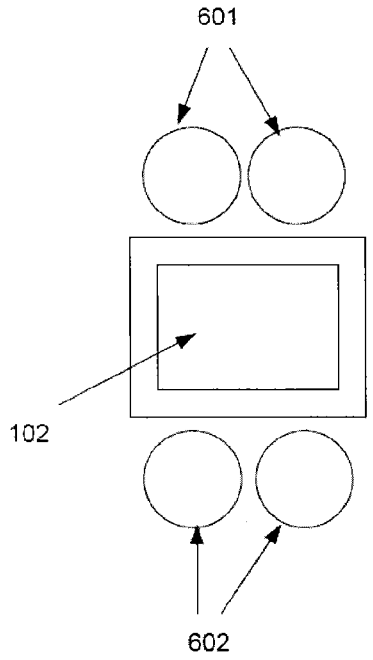
FIGS. 6A and 6B are illustrative views of a first embodiment of a nozzle arrangement used for an alternating blowing mechanism, and a corresponding timing of blowing nozzle groups, respectively.
Figure 6B:
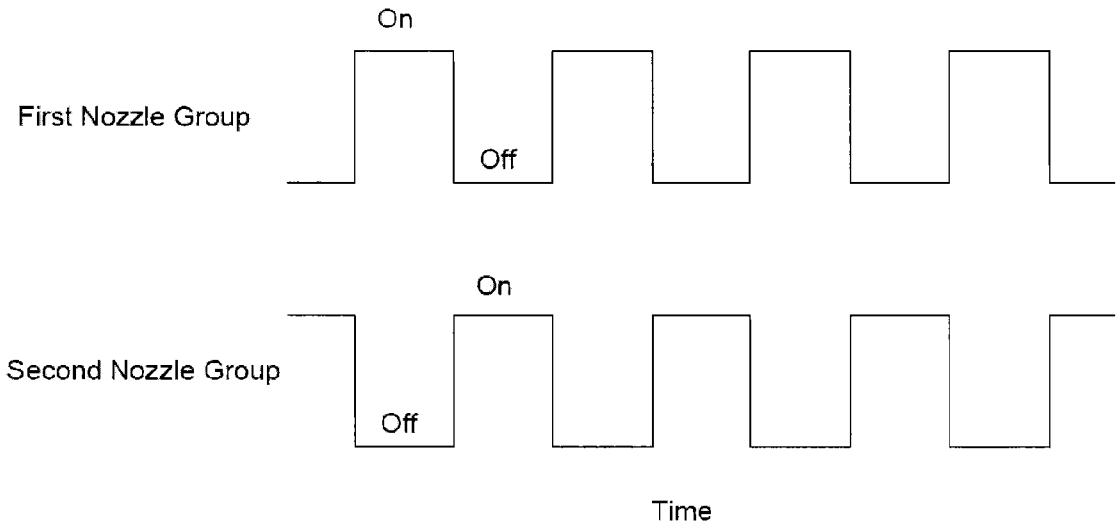

FIGS. 6A and 6B are illustrative views of a first embodiment of a nozzle arrangement used for an alternating blowing mechanism, and a corresponding timing of blowing nozzle groups, respectively. A suction nozzle 102 is surrounded by a first blowing nozzle group 601, and a second blowing nozzle group 602. The first blowing nozzle group 601 and the second blowing nozzle group 602 are on the opposite sides of the suction nozzle 102 with respect to each other. As shown in FIG. 6B, the first blowing nozzle group 601 and the second blowing nozzle group 602 are activated according to an alternating pattern, such that only one group is "ON" at any given time. This alternating pattern causes a repeating and bidirectional agitation effect onto stubborn debris in the area between the first blowing nozzle group and the second blowing nozzle groups.

Figure 7:
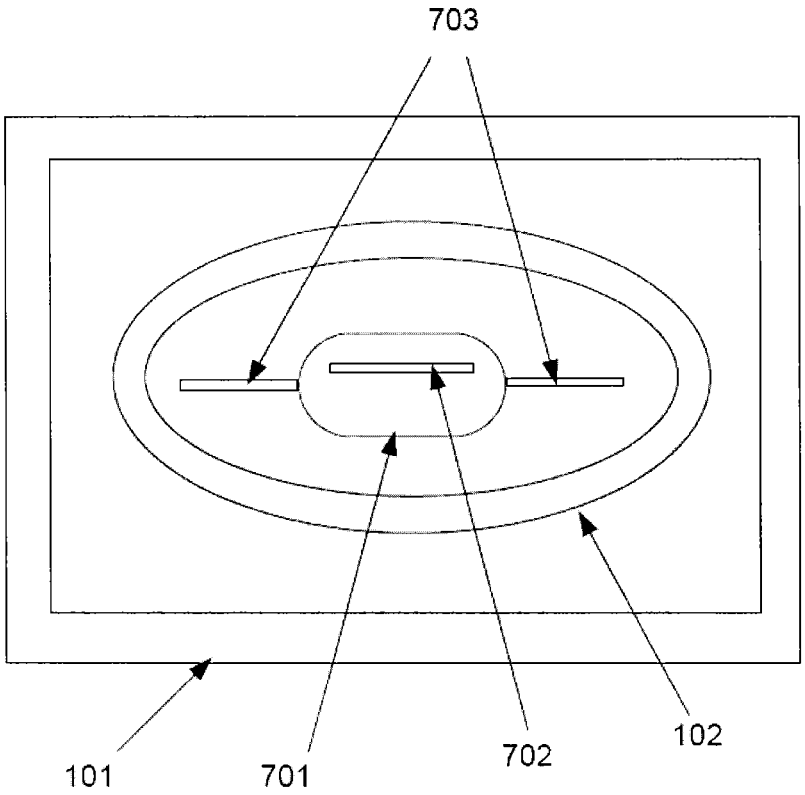
FIG. 7 is an illustrative view of an embodiment of a head portion of a vacuum cleaner with a rotating blowing nozzle.

FIG. 7 is an illustrative view of an embodiment of a head portion of a vacuum cleaner with a rotating blowing nozzle 701. The rotating blowing nozzle 701 has a cylindrical shape, and is configured to rotate along a central shaft 703. The central shaft 703 is a tube or pipe that passes through the rotating blowing nozzle 701. The central shaft 703 has openings along its surface to provide a pressured air flow path to within the rotating blowing nozzle 701. The rotating blowing nozzle 701 also has a slit 702 along its body to provide a pressured air flow exhaust path. As the pressured air is blown outside the slit 702, it causes the rotating blowing nozzle 701 to rotate along the central shaft 703, thereby mimicking the sweeping function of a rotating mechanical brush used in conventional vacuum cleaners known in the art.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A vacuum cleaner comprising:

a main body housing a suction mechanism;

a flexible head portion in communication with a low pressure side of the suction mechanism and defining a suction flow path, wherein the flexible head portion is configured to conform to irregular surfaces;

one or more suction nozzles on the head portion and defining a plurality of inlets for the suction flow path;

an external pressured air source in communication with the flexible head portion and defining a blowing flow path, wherein the external pressured air source is outside the main body; and one or more blowing nozzles on the head portion and defining a plurality of outlets for the blowing flow path, wherein the blowing nozzles are arranged into a plurality of blowing nozzle groups in opposing rows, and the blowing nozzle groups are activated according to an alternating and pulsing pattern to cause a bi-directional and repeating blown air flow in an area between the opposing rows;

wherein the flexible head portion includes a grid of a plurality of head portion units connected to each other by a plurality of joining mechanisms.

2. The vacuum cleaner of claim 1, wherein the plurality of joining mechanisms are a plurality of rotating and pivoting mechanisms.

3. The vacuum cleaner of claim 1, wherein the plurality of joining mechanisms have a relaxed state, and in the relaxed state, the plurality of joining mechanisms have a first concave shape.

4. The vacuum cleaner of claim 3, wherein the grid of a plurality of head portion units takes a second concave shape when the plurality of joining mechanisms are in the relaxed state.

5. A vacuum cleaner comprising:

a main body housing a suction mechanism;

a flexible head portion in communication with a low pressure side of the suction mechanism and defining a suction flow path, wherein the flexible head portion is configured to conform to irregular surfaces;

one or more suction nozzles on the head portion and defining a plurality of inlets for the suction flow path;

an external pressured air source in communication with the flexible head portion and defining a blowing flow path, wherein the external pressured air source is outside the main body; and one or more blowing nozzles on the head portion and defining a plurality of outlets for the blowing flow path, wherein the blowing nozzles are arranged to rotate when activated and provide a rotating blowing air flow;

wherein the flexible head portion includes a grid of a plurality of head portion units connected to each other by a plurality of joining mechanisms.

6. The vacuum cleaner of claim 5, wherein the plurality of joining mechanisms are a plurality of rotating and pivoting mechanisms.

7. The vacuum cleaner of claim 5, wherein the plurality of joining mechanisms have a relaxed state, and in the relaxed state, the plurality of joining mechanisms have a first concave shape.

8. The vacuum cleaner of claim 7, wherein the grid of a plurality of head portion units takes a second concave shape when the plurality of joining mechanisms are in the relaxed state.

* * * * *